United States Patent [19]

Dylag

[11] 4,314,700

[45] Feb. 9, 1982

[54] CARD COUNTING PREVENTION APPARATUS FOR BLACKJACK

[76] Inventor: Kenneth C. Dylag, 705 W. 65th St., Westmont, Ill. 60559

[21] Appl. No.: 193,419

[22] Filed: Oct. 3, 1980

[51] Int. Cl.[3] ..... A63F 1/06

[52] U.S. Cl. ..... 273/148 R; 108/60; 273/309; 434/432

[58] Field of Search ..... 273/148 A, 148 R, 309, 273/274, 265; 434/237, 350, 351, 352, 432; 108/60, 61

[56] References Cited

U.S. PATENT DOCUMENTS

| | | | |
|---|---|---|---|
| 2,262,575 | 11/1941 | Cons et al. | 108/25 |
| 3,117,534 | 1/1964 | Martland | 434/432 X |
| 3,462,855 | 8/1969 | Cornish | 434/222 |
| 3,477,760 | 11/1969 | Bue et al. | 108/60 X |
| 3,600,826 | 8/1971 | Thomas et al. | 434/237 |
| 3,698,104 | 10/1972 | Sutton | 434/432 |
| 3,768,176 | 10/1973 | Huddleston | 434/237 |

FOREIGN PATENT DOCUMENTS

| | | | |
|---|---|---|---|
| 72927 | 6/1945 | Norway | 273/148 R |

*Primary Examiner*—Anton O. Oechsle
*Attorney, Agent, or Firm*—Patrick G. Burns; Thomas W. Speckman

[57] ABSTRACT

Apparatus for preventing card-counting in blackjack games includes one or more shields on a playing table which obstruct each player's view of at least one other player's cards, without obstructing each player's view of the dealer's cards or the dealer's view of any of the cards. One or more shields may be used. They may be fixed to the table, or they may be portable so that the dealer may move them during the game if he or she wishes. Portable shields may be supported by legs, or may be inserted in grooves in the table. Each shield is a thin sheet of opaque material which stands generally vertical with respect to the table. The plane defined by the shield generally passes through the dealer's line of sight so that the dealer's view of the players' cards, and each player's view of the dealer's cards, is not obstructed. However, each player's view of at least one other player's cards is obstructed so that none of the players may count cards. A checker vantage point is provided over the table from which a checker may view the dealer's card and each of the player's cards.

26 Claims, 5 Drawing Figures

CARD COUNTING PREVENTION APPARATUS FOR BLACKJACK

BACKGROUND OF THE INVENTION

This invention relates to apparatus for preventing card counting in blackjack, and more particularly to shields on a blackjack table which obstruct each player's view of at least one other player's cards.

Blackjack is a widely known game of skill which is often played in gambling casinos and the like. The game may be played with one or more decks of fifty-two cards, and several players may play against the dealer, who plays for the casino, at any given time.

A relatively low number of cards are used for each hand, and the deck is not shuffled following each play. By counting some of the cards which have been played, a player may calculate the general composition of the remaining unplayed cards. For example, by counting the number of tens which have been played and the total number of cards, a player may calculate the percentage of tens in the unplayed cards.

Generally, of course, the odds of winning favor the casino. However, when the pack of unplayed cards includes a disproportionately high number of tens and aces, the player has a slight advantage.

Skilled players have developed various systems for counting cards as they are played to determine whether the pack includes a disproportionately high number of tens and aces. When this occurs, the players generally bet more than they would otherwise, because the odds are favorable. Players who are proficient card-counters have won thousands of dollars using such card-counting systems.

Most gambling casinos employ people known as checkers to observe blackjack games and identify players who may be counting cards or cheating. The checkers often view the games through the ceiling or from catwalks above the game table. If they detect a card-counter, the card-counter may be barred from the game.

Checkers cannot always identify card-counters, and the legality of barring players from the game for card-counting is unclear. Thus, there is a need to prevent card-counting in blackjack games, without relying on a checker or barring players from the game.

Card-counting could be prevented by adding a rule which forbids it. To enforce the rule, however, other rules would have to be changed, as well. Many players would not play the game for a period of time if the rules were changed substantially, which would result in a loss to the casino. Thus, there is a need for apparatus which prevents card-counting in blackjack games without substantially changing the rules of the game.

Accordingly, an object of this invention is to provide apparatus for preventing card-counting in blackjack games without relying on a checker.

Another object is to provide apparatus for preventing card-counting in blackjack games without barring players from the game.

Yet another object is to provide apparatus for preventing card-counting in blackjack games without substantially changing the rules of the game.

Still another object is to provide a shield which obstructs each player's view of the cards of at least one other player, without obstructing each player's view of the dealer's cards, the dealer's view of each of the players' cards, or a checker's view of the game.

SUMMARY OF THE INVENTION

In keeping with one aspect of this invention, apparatus for preventing card-counting in blackjack games includes one or more shields on a playing table which obstruct each player's view of at least one other player's cards, without obstructing each player's view of the dealer's cards or the dealer's view of any of the cards. One or more shields may be used. They may be fixed to the table, or they may be portable so that the dealer may move them during the game if he or she wishes. Portable shields may be supported by legs, or may be inserted in grooves in the table. Each shield is a thin sheet of opaque material which stands generally vertical with respect to the table. The plane defined by the shield generally passes through the dealer's line of sight so that the dealer's view of the players' cards, and each player's view of the dealer's cards, is not obstructed. However, each player's view of at least one other player's cards is obstructed so that none of the players may count cards.

BRIEF DESCRIPTION OF THE DRAWINGS

The above mentioned and other features of this invention and the manner of obtaining them will become more apparent, and the invention itself will be best understood by reference to the following description of an embodiment to the invention taken in conjunction with the accompanying drawings, in which.

DESCRIPTION OF THE PREFERRED EMBODIMENTS

Figure 1:
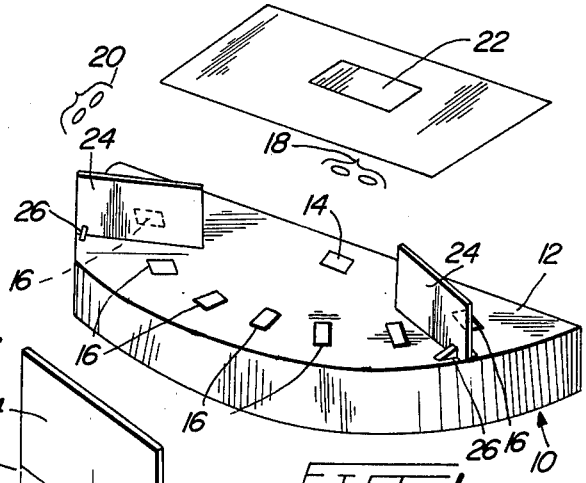
FIG. 1 is a perspective view of a blackjack table including one arrangement of the card-counting prevention apparatus of this invention.

As shown in FIG. 1, a blackjack table 10 includes a top 12 having a dealer station 14 on one side of the table and a plurality of player stations 16 on the opposite side of the table. Most tables include seven player stations arranged on top 12 in an arc or other configuration which partially surrounds dealer station 14. The dealer, who stands or sits at the table 10 behind dealer station 14, may view the table from a dealer vantage point 18, shown in FIG. 5. Players, who generally sit at the table 10 behind the player stations 16, may view the entire table from player vantage points 20 adjacent each player station 16. Both the dealer vantage point 18 and the player vantage points 20 are somewhat above and behind the table 10, as seen in FIGS. 1 and 5.

A person employed to observe the game to detect card-counting, cheating and the like, generally known as a checker, may view the entire table 10 from a checker vantage point 22 (FIG. 1) above the table.

At least one shield 24 resting on top 12 obstructs the view of at least one of the player stations 16 from each of the player vantage points 20, without obstructing the view of any of the player stations 16 from the dealer vantage point 18, the dealer station 14 from any of the player vantage points 20, and the dealer station 14 and each of the player stations 16 from the checker vantage point 22. One shield 24 properly placed between two player stations will accomplish these purposes, provided that one player sits on each side of the shield. If desired, however, a shield may be placed between more than one pair of player stations 16, or between every pair of player stations 16.

Figure 5:
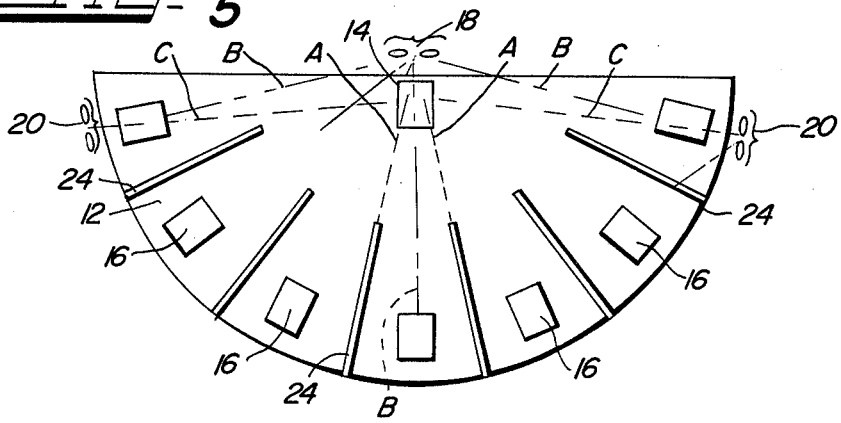
FIG. 5 is a top view of the table of FIG. 3.

Each shield 24 is preferably positioned on top 12 so that the plane A formed by the shield 24 intersects dealer vantage point 18, as seen in FIG. 5. This insures that the dealer's view B of the player stations 16 and each player's view C of dealer station 14 are not obstructed.

Shield 24 is generally vertical on top 12 so that it does not obstruct the view of any of the player stations 16 or the dealer station 14 by the checker at checker vantage point 22 (FIG. 1).

The shields 24 may be secured to the top 12 by screws, brackets, or any suitable means, or may be portable, so that the dealer may move them between various player stations 16 at different times, depending on which player stations 16 are being played.

Figure 3:
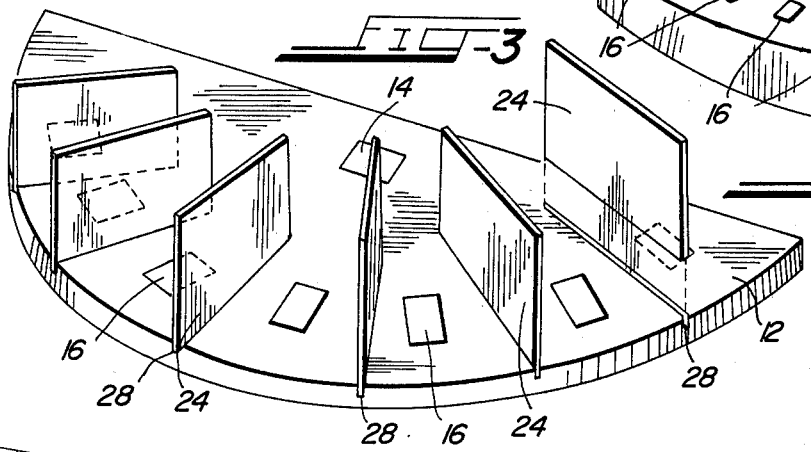
FIG. 3 is a perspective view of an alternate embodiment of the invention.

Portable shields 24 may be maintained in a substantially vertical position with respect to the top 12 by a leg 26 secured to each side of the shield 24, as seen in FIG. 3. Legs 26 may be secured at one end of the shield 24 by any suitable means, including adhesive. The shield 24 is preferably positioned on table 10 so that the legs 26 are adjacent the players, as in FIG. 1. Such placement of the legs 26 prevents the legs from interfering with the game.

In the alternate embodiment shown in FIG. 3, the shields 24 are slidably held in grooves 28 in top 12. The shields 24 are portable, and may be moved by the dealer as desired.

Figure 2:
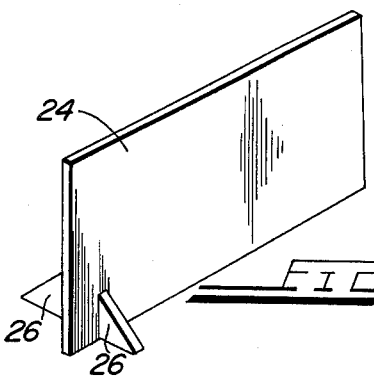
FIG. 2 is a perspective view of a portable shield shown in FIG. 1.

The shield 24 (FIG. 2) may be any suitable size which obstructs each player's view of of at least one of the player stations 16. Shield 24 is generally a thin rectangular sheet which may be made of any suitable opaque material, such as colored plastic, wood, metal or the like. A suggested embodiment is a shield made of opaque plastic about twenty inches long, twelve inches high and one-quarter inch thick.

Figure 4:
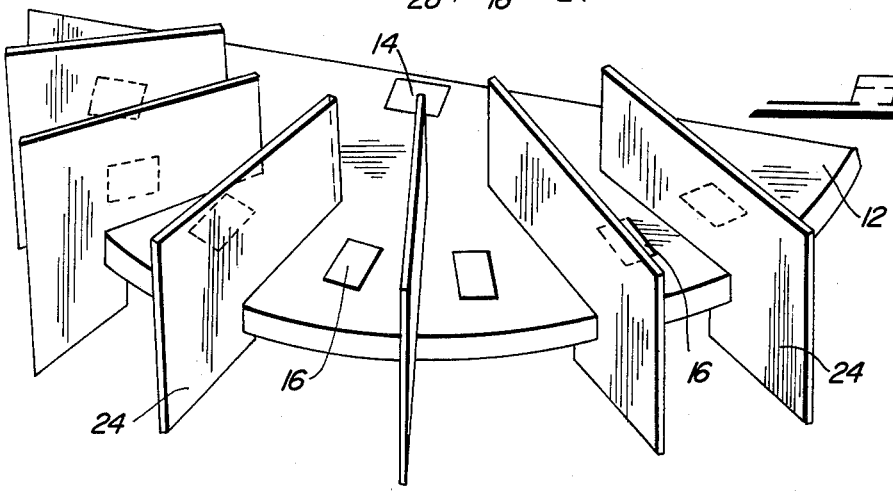
FIG. 4 is a perspective view of another alternate embodiment of the invention.

The shields 24 may extend away from the dealer station 14 beyond the player stations 16, as shown in FIG. 4. This further obstructs each player's view of the other player stations 16, and prevents players from leaning back to look around the shields 24.

Many shield configurations are contemplated by this invention. The only configuration requirement is that a shield be located between two player stations 16 which are in use. Any number of additional shields 24 may be used, if desired.

One possible configuration is shown in FIG. 1, where a shield is placed between the two player stations 16 furthermost to the left of the dealer and between the player stations 16 furthermost to the right of the dealer. This configuration prevents each player from viewing at least one other player's cards, particularly when players are seated at the two player stations furthest to the left and furthest to the right of the dealer. Numerous other configurations may be used, provided that a player is seated on each side of at least one shield.

The many advantages of this invention are now self-apparent. Card counting may be prevented without substantially changing the rules of the game or the layout of the table. The dealer's view of the game and the checker's view are not obstructed, and there is no need to prevent anyone from playing the game for counting cards.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein may be varied considerably without departing from the basic principles of the invention.

I claim:

1. Apparatus for preventing card-counting in blackjack played at a blackjack card table comprising a table, a dealer station on one side of said table having a dealer vantage point above and behind said dealer station from which a dealer may view said table, a plurality of player stations on the opposite side of said table, each said player station having a player vantage point above and behind each of said player stations for viewing said table, said player stations partially surrounding said dealer station, a checker vantage point over said table from which a checker may view said table, and means for obstructing the view of at least one of the said player stations from each of said player vantage points without obstructing the view of any of said player stations from said dealer vantage point, said dealer station from any of said player vantage points, and said dealer station and each of said player stations from said checker vantage point.

2. The apparatus of claim 1 wherein said player stations form an arc partially surrounding said dealer station.

3. The apparatus of claim 1 wherein said obstructing means comprises an opaque shield adjacent said table between any two of said player stations, and means for maintaining said shield substantially vertical with respect to said table.

4. The apparatus of claim 3 wherein the plane formed by said shield intersects said dealer vantage point.

5. The apparatus of claim 3 wherein said shield is not secured to said table and may be moved by said dealer between different player stations, and said maintaining means comprises a leg secured to each side of said shield.

6. The apparatus of claim 5 wherein said shield is adjacent said table with said legs adjacent said player stations, away from said dealer station.

7. The apparatus of claim 1 wherein said obstructing means comprises a plurality of opaque shields adjacent said table between pairs of said player stations, and means for maintaining said shields substantially vertical with respect to said table.

8. The apparatus of claim 7 wherein said shields are not secured to said table and may be moved by said dealer between different player stations, and said maintaining means comprises a leg secured to each side of each of said shields.

9. The apparatus of claim 8 wherein said shields are adjacent said table with said legs adjacent said player stations, away from said dealer station.

10. The apparatus of claim 7 wherein said obstructing means comprises a first shield between the first two player stations furthermost to the left of said dealer, and a second shield between the two player stations furthermost to the right of said dealer.

11. The apparatus of claim 7 wherein said maintaining means comprises a plurality of grooves in said table between said player stations, said shields slidably fitting into said grooves.

12. The apparatus of claim 7 wherein said shields are secured to said table.

13. The apparatus of claim 7 wherein said shields extends away from said dealer station beyond said player stations.

14. The apparatus of claim 3 wherein said maintaining means comprises a groove in said table between two of said player stations, said shield slidably fitting into said groove.

15. The apparatus of claim 3 wherein said shield is secured to said table.

16. The apparatus of claim 3 wherein said shield extends away from said dealer station beyond said player stations.

17. The apparatus of claim 7 wherein said shields are approximately twenty-inches long, twelve inches high and one-quarter inch thick.

18. In a blackjack card table having a table, a dealer station on one side of said table having a dealer vantage point above and behind said dealer station from which a dealer may view said table, a plurality of player stations on the opposite side of said table, each said player station having a player vantage point above and behind each of said player stations for viewing said table, said player stations partially surrounding said dealer station, and a checker vantage point over said table for viewing said table, the improvement comprising: means for obstructing the view of at least one of said player stations from each of said player vantage points without obstructing the view of any of said player stations from said dealer vantage, said dealer station from and of said player vantage points, and said dealer station and each of said player stations from said checker vantage point, and means for maintaining said obstructing means in substantially vertical communication with said table.

19. The improvement of claim 18 wherein said player stations form an arc partially surrounding said dealer station.

20. The improvement of claim 18 wherein said obstructing means comprises a vertical opaque shield adjacent said table between any two of said player stations.

21. The improvement of claim 20 wherein said shield is portable and may be moved by said dealer between different player stations, and said maintaining means comprises a leg secured to each side of said shield.

22. The improvement of claim 21 wherein said shield is adjacent said table with said legs adjacent said player stations, away from said dealer station.

23. The improvement of claim 18 wherein said obstructing means comprises a plurality of opaque shields adjacent said table between pairs of said player stations.

24. The improvement of claim 23 wherein said shields are portable and may be moved by said dealer between different player stations, and said maintaining means comprises a leg secured to each side of said shield.

25. The improvement of claim 23 wherein said shields are secured to said table.

26. The improvement of claim 23 wherein said shields extend away from said dealer station beyond said player stations.

* * * * *

UNITED STATES PATENT AND TRADEMARK OFFICE

CERTIFICATE OF CORRECTION

PATENT NO. : 4,314,700

DATED : February 9, 1982

INVENTOR(S) : Kenneth C. Dylag

It is certified that error appears in the above—identified patent and that said Letters Patent is hereby corrected as shown below:

In column 5, line 4, delete "extends" and insert --extend--;

In column 5, line 31, between "vantage" and ",", insert --point--; and

In column 5, line 31, delete "and" and insert --any--.

Signed and Sealed this

*Twentieth* Day of *July 1982*

[SEAL]

*Attest:*

GERALD J. MOSSINGHOFF

*Attesting Officer*

*Commissioner of Patents and Trademarks*